United States Patent [19]

Birdwell

[11] Patent Number: 4,932,005

[45] Date of Patent: Jun. 5, 1990

[54] FLUID MEANS FOR DATA TRANSMISSION

[76] Inventor: J. C. Birdwell, 8535 Glencrest, Houston, Tex. 77061

[21] Appl. No.: 173,197

[22] Filed: Sep. 22, 1988

Related U.S. Application Data

[63] Continuation of Ser. No. 762,426, Aug. 5, 1985, abandoned, which is a continuation-in-part of Ser. No. 220,527, Dec. 29, 1980, abandoned, which is a continuation-in-part of Ser. No. 455,509, Jan. 4, 1983, Pat. No. 4,541,779, which is a continuation-in-part of Ser. No. 529,487, Sep. 6, 1983, Pat. No. 4,611,973, which is a continuation-in-part of Ser. No. 680,849, Dec. 12, 1984, abandoned, which is a continuation-in-part of Ser. No. 692,319, Jan. 16, 1985, Pat. No. 4,676,724.

[51] Int. Cl.[5] ..... G01V 1/40

[52] U.S. Cl. ..... 367/83; 125/48

[58] Field of Search ..... 367/83, 84, 85; 175/48, 175/50

[56] References Cited

U.S. PATENT DOCUMENTS

H55 5/1986 Ramsey et al. ..... 367/83

4,694,439 9/1987 Moll ..... 367/83

4,774,694 9/1988 Moll ..... 367/83

*Primary Examiner*—Thomas H. Tarcza

*Assistant Examiner*—Ian J. Lobo

*Attorney, Agent, or Firm*—Gunn, Lee & Miller

[57] ABSTRACT

A means to transmit recorded data through a fluid medium is disclosed. The preferred embodiment incorporates a positive displacement fluid pump having constant pressure pumping means connected to pump fluid through a drill string for drilling oil wells. A variable orifice means is located down hole in the drill string which changes orifice diameter responsive to sensed data. The pumped fluid is displaced by a pumping piston driven by a second piston powered by constant pressure hydraulic fluid. The pumped fluid is held at a constant pressure so that a change in orifice diameter will change the volume of the flow through the orifice and likewise change the volume of flow of the hydraulic drive fluid. The flow rate of the hydraulic drive fluid is thus gauged to thereby record the orifice diameter change and in turn receive signals transmitted by the change in orifice diameter.

12 Claims, 2 Drawing Sheets

FLUID MEANS FOR DATA TRANSMISSION

REFERENCE TO OTHER APPLICATIONS

This is a continuation of application Ser. No. 762,426 filed Aug. 5, 1985, and now abandoned, which was a continuation in part or contained subject matter in common with applications 06/220,527 filed Dec. 29, 1980, and now abandoned; Ser. No. 06/455,509 filed Jan. 4, 1983, and now U.S. Pat. No. 4,541,779; Ser. No. 06/529,487 filed Sept. 6, 1983, and now U.S. Pat. No. 4,611,973; Ser. No. 06/680,849 filed Dec. 12, 1984 and now abandoned; and Ser. No. 692,319 filed Jan. 16, 1985, and now U.S. Pat. No. 4,676,724.

SUMMARY OF THE INVENTION

The present apparatus is directed to a means to transmit recorded data through a fluid medium and more particular to a means to transmit recorded data from an instrument located in a oil well sub-surface drill string to a surface recording means, the transmission occuring through the circulation fluid medium employed to assist in drilling the well. In drilling oil wells, it is desireable to log the different earth formations, well temperature, bore hole deviation, etc., as the wells are being drilled. Thus various recording instruments are placed in the drill string generally near the drill bit to log this different data. It is also desireable to transmit this data to the surface while the well is being drilled. This transmission data to the surface during drilling is a difficult process because of numerous transmission problems that have to be overcome. The most successful means of transmitting these signals to the surface presently consists of magnification of the logged data by batteries or other means and employing the data to create pressure pulses in the circulating drilling fluid medium, the pulses generally being created by valve means either momentarily restricting the flow of drilling fluid or momentarily dumping a part of the flow of drilling fluid. The pressure pulses in turn travel through the drilling fluid to the surface where they are received by a recording instrument.

Numerous problems exist with the transmission of pressure pulses through the drilling fluid including the many and varied pulsations transmitted to the same fluid by the drilling fluid pump. The system of this invention employees the technique of holding the drilling fluid pressure relatively constant, thus varying the flow rate of the drilling fluid and recording the various flow rates at the surface. In my technique the same type down hole logging tools and down hole signaling devices are employed, except the signaling device will in turn change the flow rate of the drilling fluid which in turn is recorded at the surface, thus eliminating the necessity to send pressure pulses through the fluid medium.

DETAILED DESCRIPTION OF THE PREFERRED EMBODIMENT

Figure 1:
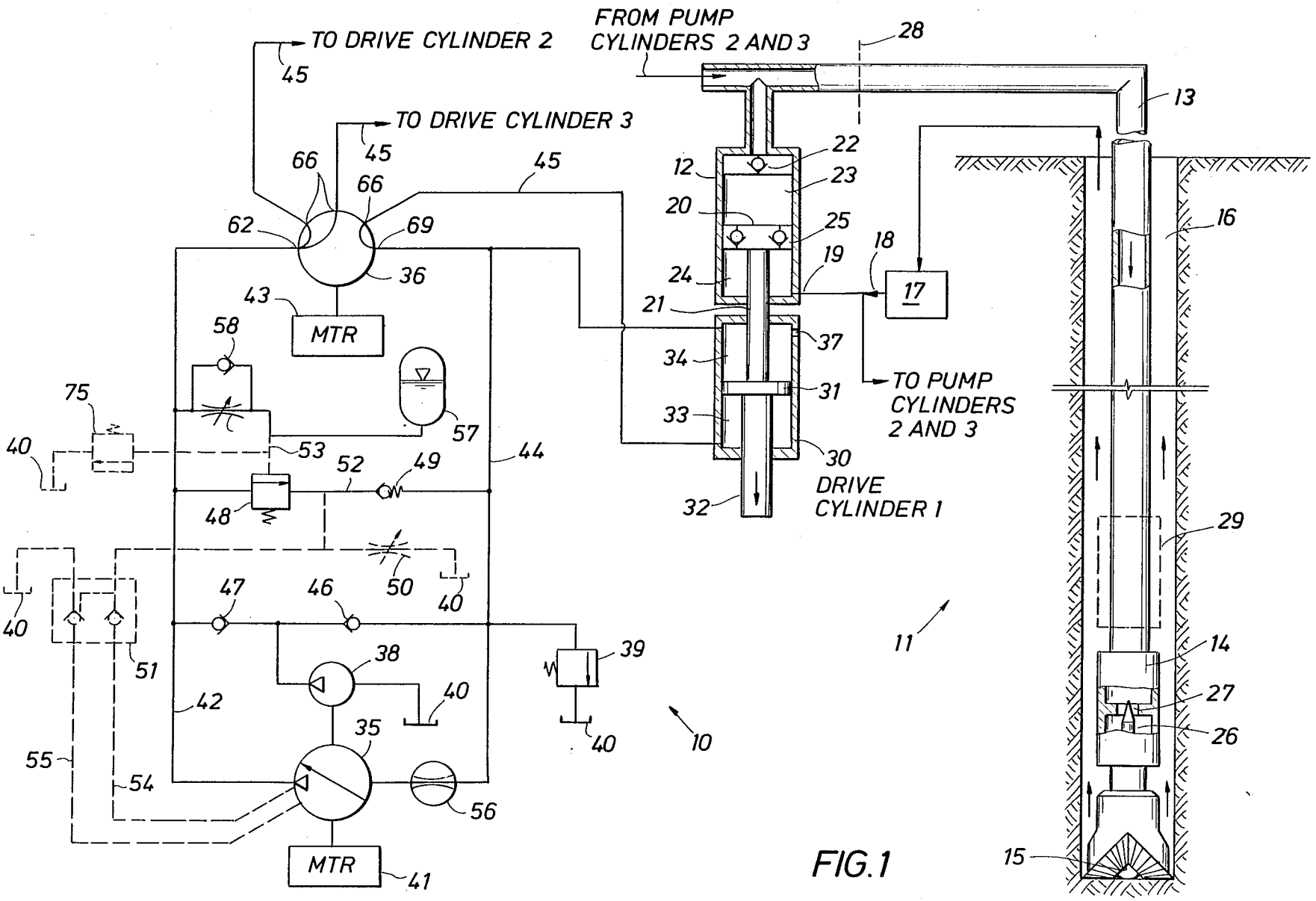
FIG. 1 is a schematic drawing illustrating the arrangement of the different components that constitute the signal transmission means of this invention.

Attention is first directed to FIG. 1 of the drawings where the numeral 10 generally identifies a hydraulic driven pump that has the capability to create and sustain a constant pressure pumped fluid system. The numeral 11 generally identifies a drilling fluid circulating system circulating drilling mud through a pumping cylinder 12, a drill string 13, a down hole logging device 14, a drill bit 15, a bore hole 16, and a mud reservoir 17.

Pumping cylinder 12 is one of three pumping cylinders of the pump illustrated by the numeral 10. The circulating fluid, which generally is a weighted drilling mud, is drawn from reservoir 17 through line 18 and into the pumping chamber at 19. A reciprocating piston 20 driven by rod 21 discharges fluid from a chamber 23 across unidirectional outlet valve 22 as piston 20 moves in one direction on its power stroke. At the same time fluid is drawn into a chamber 24 behind piston 20. Piston 20 next moves on its return stroke at which time the fluid is transferred from chamber 24 to chamber 23 moving across one or more unidirectional valves 25 carried in movement by piston 20. A small amount of fluid equal to the rod 21 area in volume will be drawn into chamber 23 from reservoir 17 as piston 20 moves in return stroke.

Pump 10 can function with two or more cylinders 12 to provide constant pressure pumping, however the preferred embodiment employs three or more cylinders 12. Inlet line 18 is connected in parallel to all cylinders 12 and the drill string 13 is connected in parallel to the outlet of all cylinders 12. The piston 20 in each of all cylinders 12 is driven in sequential order and overlapping drive movement whereby the total output of flow from all cylinders 12 is uniform in constant volumetric flow for a given fluid displacement. Each piston rod 21 is driven in pumping movement with a constant force which in turn creates a constant pressure in chamber 23 and in the circulating fluid passing through drill string 13. The means to drive piston rod 21 with a constant force will be discussed later.

Since logging device 14 can be any number of different down hole monitoring systems, it can be a device to monitor or log the different earth formations, the down hole temperature, bit rotation, bit inclination, etc. These devices generally employ highly sophisticated and complex means to pick up a signal, magnify the signal and then transmit the signal into movement of some type of plunger of valving device such as plunger 26 to restrict a typical orifice 27 through which the circulating fluid flows. This plunger manipulation technique is well known by those versed in the art. In the present state of the art, this or similar means are employed to create pressure pulses in circulating fluid to transmit data to the surface.

This same logging technique can be employed in my system of transmitting data, however in the constant pressure circulating fluid system of this invention the same restricting or opening up of orifice 27 causes a change in circulating fluid flow rate. This change in flow rate then forms the means for transmitting the logged signal to the surface. For example, if orifice 27 is, for example one square inch in flow area, then a constant pressured fluid will pass a constant flow of say 100 gallons per minute across the orifice. But if the orifice is increased in flow area to, say, one and one half square inches, then the same constant pressure will pass a increased flow across the orifice. Likewise if orifice 27 is decreased in flow area, then the flow across the orifice will decrease in volume.

Thus by recording the flow rate of the pumped circulating fluid at a surface location such as 28 and correlating the change in flow rates with the known characteristics of the signal producing logging instrument, then the signal produced by the logging device can be instantly interpreted at the surface location.

In the drilling of wells the drill bit is either rotated by some type of down hole motor located near the bit such as 29, or the complete drill string is rotated from a surface rotary table which naturally requires a swivel of some type in the drill string above the rotary table. In the illustrated schematic of equipment the rotary table and swivel are omitted for sake of clarity because their functions obviously have no bearing upon this data transmission means.

The down hole motor 29 is located in a position above the logging instrument 14. Motor 29 could also be located at a point below the logging instrument 14 if desired. It's generally desireable to have the logging instrument located as close as possible to the drill bit; for example if the instrument is logging a potential oil bearing formation, then it is desireable to have data transmitted to the surface as soon as possible after the drill bit enters the formation. This is is advantageous to be able to locate the logging instrument below the motor and still transmit signals.

Motor 29 is generally a motor driven by the circulating fluid. Thus with the present state of the art of transmitting signals by the creation of pressure pulses, it's obvious that difficulties arise due to signal interferences by the motor if the signaling device is located below the motor. In the system of this invention the transmission of signals will cause a change in speed of a down hole motor driven by the circulating fluid but there should be no appreciable interference with signal transmission whether the motor is above or below the logging device. From the above discussion it's obvious logging device 14 can be utilized to speed up or slow down the rotation of down hole motor 29 by increasing or decreasing the flow rate of the circulating fluid passing through motor 29. The state of the art of typical logging instrument 14 provides for the instrument to pick up its signals from many and various different sources, thus any of these various sources can be utilized to in turn control the rotation speed of motor 29 that is driven by the circulating fluid. For example, instrument 14 can be programmed to close orifice 27 upon a given temperature or pressure thus stopping motor 29; or instrument 14 can be programmed to enlarge orifice 27 when a particular type earth formation is encountered to increase the drilling speed of motor 29.

Thus from the above it is illustrated that the constant pressure circulating fluid system of transmitting signals also can provide down hole motor automatic speed control capabilities, or the transmitting of signals from a first to a second or more down hole instruments.

Attention is further directed to FIG. 1 of the drawings where the numeral 10 generally identifies the hydraulic driven pump utilized to create the constant pressured circulating fluid system illustrated by numeral 11. Numeral 10 generally identifies a hydraulically driven cylinder 30 having a reciprocating drive piston 31 drivingly connected on one side to piston rod 21 and having on its other side a rod 32 sealingly extended through the end of cylinder 30. Each pumping cylinder 12 is driven by a specific cylinder 30 and associated piston. Rod 32 has a larger cross section area than the rod 21 so that equal pressure upon both faces of piston 31 will move piston 31 in the direction of rod 32. Rod 32 and piston 31 define an expansionable drive fluid chamber 33 on one side of piston 31, and rod 21 and piston 31 define a part of an expansionable return fluid chamber 34 on the other side of piston 31. A fluid port 37 is fluidically connected to chambers 34 of all other drive cylinder 30 to form an interconnected chamber 34 common to all cylinders 30.

The driving movement of piston 31 provides the drive means that creates the constant pressure drilling fluid system previously discussed. Constant pressure hydraulic drive fluid is connected with each drive chamber 33 in sequential and overlapping turn to move or not move piston 31 in pressured circulating fluid displacement or non displacement where the circulating fluid displacement is dependent upon the opening size of orifice 27. In other words, if orifice 27 allows fluid to circulate then the drilling fluid will circulate with a volumetric flow rate relative to the orifice flow area. If orifice 27 allows no flow to pass therethrough, then the circulating fluid will be static with a constant applied pressure.

It is noted at this point that a leak in the constant pressure circulating system can be detected any time orifice 27 is closed by monitoring the flow rate at typical plane 28, any flow of fluid across this plane indicates a correspondingly sized leak. This fact can be especially useful in checking leakage of the threads of the different joints of drill pipe employed in the drill string. Also this leak test can be employed to check each tool joint thread as the drill string is being lowered into the hole by having orifice 27 in a closed position and checking each joint after the joint is added to the drill string. A typical orifice 27 could be programmed to permanently release after the drill bit reaches bottom.

Also the constant pressure circulating fluid can be utilized to check for leakage of added tool joint threads during drilling operations by the technique of noting the flow rate of fluid crossing plane 28 immediately prior to lowering circulating pressure for adding the next tool joint. After the joint is added and pressure is resumed, then an increase in the noted flow rate would indicate a leakage of the threads just added, assuming orifice 27 does not change in size.

Refer again to numeral 10 of FIG. 1. As the chambers 33 of the drive cylinders 30 are in turn connected with a constant hydraulic drive fluid pressure to thereby maintain the constant pressure upon the circulating fluid, each chamber 33 not connected with the hydraulic drive fluid (from the pump 35) is connected with chamber 34. A low pressure hydraulic fluid supply system connects to a hydraulic drive pump 35 that supplies the constant pressure hydraulic drive fluid. The sequential and in turn connection between commonly connected chambers 34 and each chamber 33 is accomplished by a valving means 36 that will be explained later; this valve connection provides the same low pressure fluid to both faces of piston 31 to overcome the difference in piston 31 face areas because of rod 32 and rod 21 and moves the piston 31 in the return direction.

The primary source of piston 31 return movement at one cylinder is supplied by one or more drive pistons 31 at other cylinders moving in the drive direction which displaces fluid from one or more chambers 34 through commonly interconnected ports 37. One or more pistons 31 moving in the drive movement will in turn drive other or remaining pistons 31 in return movement through interconnected fluid chambers 34.

A secondary source or return piston movement is supplied by a system charge pump 38 connecting with chambers 34 and the inlet of hydraulic pump 35 to keep chambers 34 and the inlet line to pump 35 at a pre-charged pressured state.

A relief valve 39 also connects with chambers 34 and the inlet line to pump 35. Valve 39 exhausts excess fluid to a hydraulic reservoir 40. The relief valve 39 is adjusted to bypass fluid to reservoir 40 whenever the fluid in chambers 34 reach a pressure slightly higher than the pressure required to drive piston 31 in the return direction. This setting cannot be exactly calculated and should be determined after assembly of the cylinders 12 and 30. Each assembly of cylinders 12 and 30 will require slightly different chamber 34 return pressure due primarily to difference in frictional drag; thus valve 39 must be set to relieve fluid at a pressure higher than the piston 31 return pressure of all assemblies 12 and 30.

In operation, the combined total volume of the chambers 34 continuously expands and contracts. The volume will expand as long as any piston 31 is free to move unrestricted in the return direction. The volume will contract when all returning pistons reach the end of their strokes and a driving piston 31 raises the pressure in chamber 34 to the relief valve 39 setting to exhaust excess fluid. This exhausting process normally occurs upon each piston 31 return stroke, except when the stroke length of any piston 31 is shortened. When the stroke length of piston 31 is shortened during pumping operation, then all pistons 31 will move toward the return direction in shortened stroke length. The dumping of excess fluid does not occur during this movement as all chambers 34 are in the process of expansion.

All pistons 31 will thus reciprocate infinitely close to the fully returned end of cylinder 30 as the pistons are driven in infinitely short stroke and all chambers 34 become infinitely close to their maximum filled capacity. During experimentation it was verified that the expansion of chambers 34 was the only practical means to accomplish piston 31 stroke length change without interruption of the constant pumping action to provide the constant pressure status of the pumped circulating fluid. For example, if chambers 34 are held at a given filled capacity that is required to support pistons 31 reciprocating at full stroke as has heretofore been disclosed by Smith (U.S. Pat. No. 3,295,451) for a different but similar type pump, then as the pistons 31 reciprocate in shortened stroke each piston 31 will assume a reciprocating position relative to that piston's overall drive movement resistance. One piston 31 may assume a position of reciprocation near the drive end stroke of its cylinder 30, a second piston 31 may assume a position of reciprocation near the return end of its cylinder 30, and the third piston 31 may be reciprocating at a point anywhere along the length of its cylinder 30. When this occurs it means that once the pistons have assumed skew positions relative to their reciprocation, then it is impossible to again increase the stroke length without at least one drive piston 31 hitting the end of its stroke too soon thus interrupting the continuity of the constant drive action of pistons 31, and in the case of Smith (U.S. Pat. No. 3,295,451) it would lock up his system because his valve movement is timed with and dependent on his piston movement.

Also, prohibitive and destructive pressure surges in both the hydraulic drive fluid and the pumped circulating fluid will occur when a piston 31 hits the end of its stroke too soon. Further, the above described skew positioned pistons 31 will normally prohibit starting of the stopped pistons 31 without encountering the same premature stoppage of pistons 31. Thus from the above discussion, it's obvious that the continued expansion of chambers 34 is necessary to achieve an uninterrupted constant pressure pumping action.

The pistons 31 in return stroke movement will always return faster than they move in drive movement because of the secondary fluid source of piston 31 return movement from pump 38. This fact makes it impossible for the drive movement of the pistons 31 and the return movement to be in the same timed movement as has been heretofore disclosed by Smith (U.S. Pat. No. 3,295,451). The normal movement of drive piston 31 is in sequential turn and overlapping constant displacement movement to supply the same movement to pumping piston 20. This mandates that the normal movement of return pistons 31 will be a sequentially interrupted overall movement. If there is an overlap in the return pistons movement it will be for all practical puposes of a non-existant magnitude. Thus, for all practical purposes, the return movements of pumping pistons 20 are non overlapping.

Referring to pumping cylinder 12 note that the unidirectional valves 25 carried in movement by pumping piston 20 provide an arrangement whereby the majority of the pumped circulating fluid is drawn to cylinder 12 during the displacement stroke of piston 20. As discussed above, the displacement movement is overlapping and overall constant as pistons 20 reciprocate; thus by employing the moveable valve 25, means is disclosed for cylinder 12 to both receive a substantial constant flow of incoming fluid and to discharge a constant flow of pumped fluid. To illustrate the significance of this arrangement, consider what would happen if fluid were drawn to cylinder 12 as piston 20 moves in its return stroke as is the normal arrangement for fluid pumps, such as Smith (U.S. Pat. No. 3,295,451); in this case the incoming suction flow would be stopped upon each return stroke movement as the return strokes have essentially zero overlap. Thus this repetitive stopping of incoming flow would create excessive incoming flow pulsation. Experiments using return piston suction arrangements show these incoming flow pulsations to be prevalent even at low flow rates and to be practically unacceptable at flow rates of 150 gallons per minute or more, when employed with free floating pistons.

Attention is again directed to FIG. 1 where the numeral 10 illustrates a closed loop hydraulic system combined with an independently sequenced valving system to drive cylinder 30 as previously discussed. This basic system was disclosed in now pending applications No. 692,319 filed Jan. 16, 1985, which was originally filed as application No. 06,133,948 filed Mar. 25, 1980. Further refinement and extensions of this basic system are now pending in applications No. 06/455,509 filed Jan. 4, 1983; No. 06/529,487 filed Sept. 6, 1983; No. 06/680,849 filed Dec. 12, 1984; and patent No. 4,500,267 issued Feb. 19, 1985. Reference is made to these documents for further discussions.

Variable volume hydraulic pump 35 is driven by a motor 41 to supply pressured hydraulic fluid through line 42 to distribution valve 36. Valve 36 is driven by a motor 43 to distribute pressure hydraulic fluid through line 45 in a continuous uninterrupted fashion in sequential turn and overlapping manner to chambers 33 of drive cylinders 31. Valve 36 also returns spend pressure fluid in sequential turn from chambers 33 to lower pressure return line 44 connecting with chambers 34 input to the inlet of pump 35. The pressure fluid is distributed by valve 36 to a single chamber 33 for a substantial part of piston 31 drive movement; then near the end of piston 31 stroke, the fluid is switched to start another piston 31 in overlapping drive movement. The return portion of valve 36 simultaneously connects all chambers 33 that are not receiving drive fluid with the return line 44 for return movement. Charge pump 38, driven by motor 41, keeps the closed loop pre-charged through check valves 46 or 47.

In operation, the pumped circulating fluid within drill string 13 is maintained in constant pressure status by maintaining a constant drive fluid pressure against drive pistons 31. This is accomplished by a relief valve 48, a check valve 49, a small orifice 50, and a lock valve 51. Relief valve 48 serves different functions. The main function is to limit the maximum pressure in line 42, which is an essential function since hydraulic pump 35 is a positive displacement type pump. Pressure is relieved from line 42 to a line 52 then across check valve 49 to low pressure line 44. Valve 48 can be any type relief valve but it is preferred that it be a type that can be remotely controlled from a pressure line 53 whereby valve 48 relieves flow to line 52 at the pressure that is held by pilot line 53. This type hydraulic relief valve is well known in the art thus a complete discussion of its operation is not necessary. This type valve can also generally be controlled by a maximum pressure manually setting and controlled anywhere below this maximum setting by the pressure held on pilot line 53.

Pump 35 is preferably a piston type pump employing a moveable swash plate that is controlled by two swash plate pistons. A typical pump 35 thus would have zero pumping displacement when the swash plate is held in a vertical plane relative to piston movement, with the swash plate being moved from the vertical plane for pumping displacement by two swash plate pistons. A remote control lever generally commands the swash plate pistons to position the swash plate for pumping action anywhere from zero to maximum displacement. A typical pump of this type is a pump employed as the pump part of a typical hydraulic hydrostatic drive unit. These pumps are well known in the art and thus complete explanation of their operation is not necessary.

Referring to FIG. 1, a line 54 connects one swash plate piston of pump 35 with line 52 through a lock valve 51. The other swash plate piston is connected by a line 55 to reservoir 40 through lock valve 51. The swash plate piston that is connected to line 55 must be the piston that is pressured to hold the swash plate in pumping displacement.

The drive fluid line 42 is held in constant drive pressure in the following manner: Valve 48 is set to relieve at the selected constant drive pressure, pump 35 is commanded to pump maximum flow when the selected pressure is reached as bypass flow crosses valve 48 and enters line 52. Check valve 49 has a spring tension to maintain a pressure differential of generally about 50 PSI on line 52 or as required to move the swash plate piston of pump 35. This pressured fluid within line 52 flows through lock valve 51 and then through line 54 and to the swash plate piston to reduce the pumping displacement of pump 35. As pressure is applied to line 54 to destroke pump 35, this pressure is also utilized by lock valve 51 to allow dumping of fluid from line 55 connected with the second swashplate piston of pump 35 whereby both pistons generally must be allowed to move to destroke pump 35. Orifice 50 is a small orifice that allows a small drainage of pressured fluid from line 52. Thus pump 35 is commanded to override its original displacement pumping and to pump at a displacement that causes a very small flow of fluid to cross valve 48, this allows the pressured flow entering valve 36 to be a constant selected pressure and the flow to be anywhere from zero to maximum displacement of the pump while the efficiency of the system approaches 100% for all flow ranges.

It is noted that the components to control the automatic displacement of pump 35 are only typical. There are numerous methods of performing this technique known to those experienced in the art, however, most methods employ a relief valve means such as 48 to start and maintain the destroking procedure.

A flow meter 56 located on the suction side of pump 35 measures the flow of hydraulic oil pumped through pump 35. This flow meter can also be used to gauge the flow of pumped constant pressure circulating fluid passing through pumping cylinders 12 since the flow of pumped circulating fluid is directly proportional to the flow of hydraulic drive fluid passing through pump 35.

Referring again to pumping cylinder 12 note that if for some reason unidirectional valve 25 of one or more cylinders 12 becomes stuck in the open position, then as this cylinder reaches its sequence during the pumping cycle it would suddenly cause the drive fluid pressure within drive chamber 33 to become practically zero. Thus this open pumping valve 25 would cause undesireable surging and also within the hydraulic drive fluid system, with the pressures cyclically surging from maximum to near zero.

To effectively eliminate the above potentially damaging conditions, a unique system is employed in hydraulic flow control consisting of a compressible gas filled accumulator 57, a variable volume orifice 58, and a check valve 59. In operation orifice 58 is set to admit a small flow to accumulator 57 from line 42. The line connecting accumulator 57, orifice 58, and check valve 59 is connected to the remote control line 53 of valve 48. Check valve 59 is positioned to block flow to accumulator 57, but to rapidly exhaust flow from accumulator 57. Thus as drive fluid pressure in line 42 is raised, a correspondingly slower rise in pressure will occur in accumulator 57 so that if a rapid surge of pressure occurs in line 42 then this allows valve 48 to bypass fluid due to the connection 43 connected to the low pressure in the accumulator 57, resulting from the accumulator 57 having not risen in pressure as rapidly as line 42 due to restriction by the orifice 58. This bypassed flow across valve 48 will in turn destroke pump 35 as previously discussed. Check valve 59 allows pressure trapped in accumulator 57 to rapidly exhaust and equalize with line 42 pressure thus allowing for repetitive surges. Reducing the size of orifice 58 lessens the magnitude of the maximum surge. If there are no large surges on line 42, then accumulator 57 will build in pressure and valve 48 can function with a normal top pressure setting as discussed.

With the control achieved by parts 57, 58, and 59, the pump 35 will be automatically destroked to pump a displacement that gives a maximum pressure surge as preselected. The maximum surge is preselected by adjustment of restriction 58. This control will be automatic and will come into play only when line 42 experiences a pressure surge or drop in pressure equal to the preselected magnitude. Another useful application of this control is when fluid pumped through chamber 12 carries solids in suspension whereby the solids tend to hold valves 25 in the open position.

Figure 2:
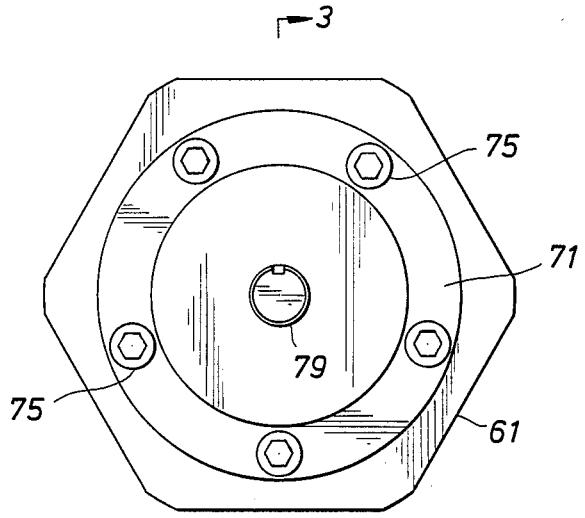
FIG. 2 is an end view of a drive fluid distribution valve employed in the schematic drawing of FIG. 1.
Figure 3:
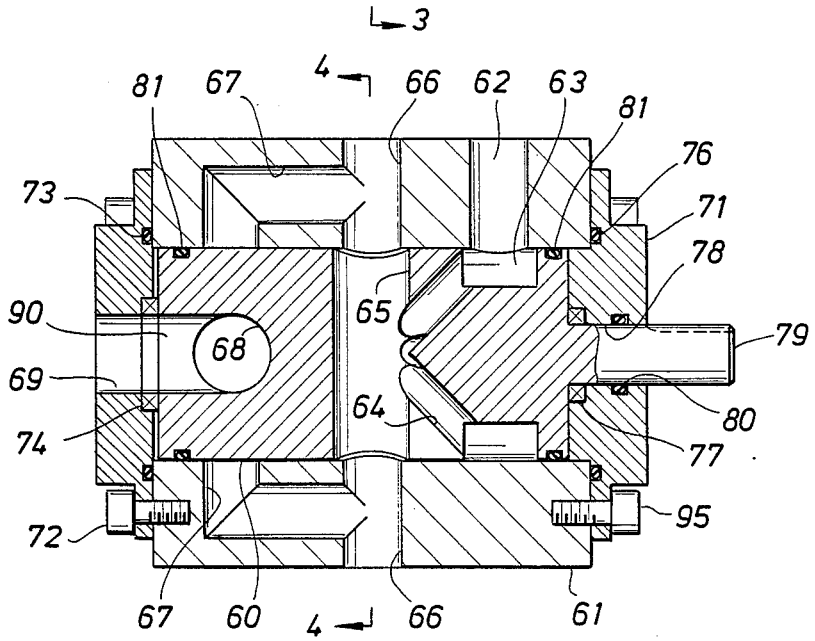
FIG. 3 is a section view taken along the lines 3—3 of FIG. 2.
Figure 4:
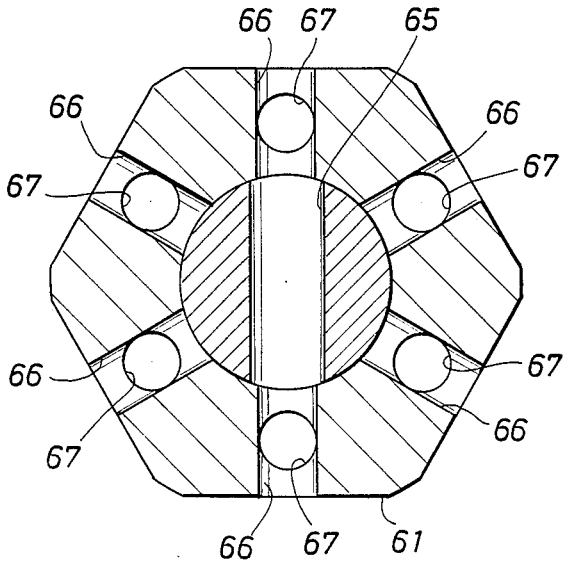
FIG. 4 is a section view taken along the lines 4—4 of FIG. 3.

Attention is next directed to FIGS. 2, 3, and 4 of the drawings where general specifics of independent driven valve 36 are shown. Specific attention is directed to FIG. 3 where a rotary spool 60 is rotatably and sealingly encased within a housing 61. Housing 61 has inlet port 62 that leads inward to grove 63 around the circumference of spool 60. Grove 63 connects through ports 64 to a crossport 65 leading through spool 60. Crossport 65 is formed to mate in rotational movement and in successive overlapping turn with multiple ports 66 formed around the circumference of housing 61. Leading from each port 66 is a connecting port 67 that connects in sucessive turn with a second crossport 68 leading through spool 60. Crossport 68 is located at 90 degrees spacing from crossport 65 and sized so that crossport 68 and crossport 65 never overlap for direct fluid flow therebetween. Crossport 68 connects to an outlet port 69 through a port 90.

Referring to the circuit illustrated by numeral 10 of FIG. 1, pressure drive fluid from line 42 enters valve 36 at inlet port 62. From there it flows through grove 63, ports 64 and then is delivered in sequential and overlapping turn to lines 45 through ports 66 to drive the pistons 31 in drive movement. Simultaneously, crossport 68 connects in sequential turn to all ports 66 not receiving driving fluid to exhaust spent driving fluid to lower pressure return line 14 and to chambers 34 to drive other pistons in return movement.

Spool 60 is sealingly and rotatably retained within housing 61 by end plates 70 and 71. End plate 70 is attached to housing 61 by bolts 72 and and has a seal at 73 and supports a thrust bearing 74 that limits end movement of spool 60 in one direction. End plate 71 is attached to housing 61 by bolts 95 and supports a seal at 76 and a thrust bearing 77 that limits end movement of spool 60 in the other direction. End plate 71 has a central opening 78 through which a drive shaft 79 of spool 60 extends. Drive shaft 79 is sealed in static and rotational movement by seal 80. Spool 60 is finely ground to sealingly mate in static and rotational movement with the inner bore of housing 61, and additional circumference seals are located at 81 on each end of spool 60.

It is noted that the constant pressure pumping system can be created only when typical orifice 27 is small enough in flow area to cause the maximum flow rate of pump 35 to set up a pressure in line 42 that is equal to the relief valve 48 setting. When orifice 27 is larger than this mandate, then the hydraulic driven pump illustrated by numeral 10 will operate as a constant displacement pump wherein a reduction in orifice 27 size will cause a rise in pumped circulating fluid pressure. These features provide the means whereby signals can be transmitted from instrument 14 by two separate and distinct channels or by numerous combinations of the separate channels. The two separate channels are through pressure pulses and by changes in circulating fluid flow rate.

Again referring to the hydraulic circuit of FIG. 1, a remote positioned relief valve 75 can be connected with vent line 53, whereby the pressure fluid bypass setting of valve 48 can be remotely changed by changing the maximum relief setting of valve 75. This is well known to those versed in the art so little explanation is necessary. Valve 75 is generally located is some type of control panel an can provide a means to easily adjust the drive circuit 42 pressure whereby the hydraulic driven circulating fluid pump can selectively function for constant pressure or constant flow pumped output.

The constant flow or constant pressure pumping modes can also be automatically selected by the down hole logging instrument 14. For example, two or more orifices 27 can be employed whereby the combined areas of all orifices give a total flow area large enough so that the maximum flow rate of pump 35 will not set up the bypass pressure requirement of valve 48. Therefore the hydraulically driven pump will pump fluid in the constant flow mode whereby signals can be transmitted by pressure pulses. However, instrument 14 can be programmed to close some of the orifices 27 upon receipt of a given signal whereby (with the orifices closed) the overall area of orifices 27 is small enough that the hydraulic driven pump will automatically operate in the constant pressure pumping mode. From the above, it is obvious that the many different pumping and signalling arrangements are too numerous to individually explain in a complete manner.

This invention is intended to cover all changes and modifications of the example of the invention herein chosen for the purpose of the disclosure, which do not constitute departures from the spirit and scope of this invention.

What I claim is:

1. A method of measuring a change in the flow rate of fluid flowing within a drill string in an oil well to transmit information concerning changes in downhole conditions from the bottom of the well to the top of the drill string, the method comprising the steps of:

(a) entrapping a first fluid within a closed container being provided with an escape outlet which outlet restricts fluid flow of the first fluid from said container;

(b) applying a pressure of constant magnitude to the entrapped first fluid;

(c) adding a controlled volume of fluid to the entrapped first fluid at a flow rate and pressure equal to the flow rate and pressure of the first fluid that flows through said escape outlet; and (d) measuring changes in the flow rate of the first fluid added to the entrapped first fluid to thereby measure any changes in the flow rate of said entrapped first fluid flowing out of the escape outlet.

2. The method of claim 1, including the step of applying said pressure of constant magnitude to the trapped first fluid by pumping pistons driven by a second fluid pressured to a constant magnitude wherein the flow rate of the second fluid is directly proportional to the flow rate of the first fluid added to the entrapped first fluid in said closed container.

3. The method of claim 2 including the step of measuring change in the size of the escape outlet by measuring change in the flow rate of said second fluid.

4. The method of claim 2 including the step of supplying added first fluid by pumping pistons driven by second fluid pressured to a constant pressure magnitude wherein the flow rate of second fluid is directly proportional to the flow rate of said fluid added to the entrapped fluid in said closed container.

5. The method of claim 1 including the step of utilizing a string of drill pipe as said container and said outlet is positioned near the lower end of the drill string and the step of measuring the change in flow rate of first fluid added to the drill string is done at a surface location.

6. The method of claim 5 including the step of transmitting a change of flow rate to a measuring instrument through entrapped first fluid in the drill string with a change in the flow rate of first fluid passing therethrough.

7. A method of conducting measurements while drilling from a downhole location to the surface along a drill string in a well borehole, the method comprising the steps of:

(a) along a drill string positioned in a well borehole and having a variable orifice serially in the drill string for forming measurement signals, pumping drilling fluid along the drill string at a specified pressure;

(b) changing the variable orifice to create a change in flow rate of drilling fluid along the drill string;

(c) pumping the drilling fluid into the drill string by a hydraulically powered means wherein hydraulic fluid is provided thereto; and (d) changing the flow rate of hydraulic fluid in relation to changes of flow rate of drilling fluid so that changes in the variable orifice are encoded in changes in the hydraulic fluid flow rate to thereby obtain a surface indication of down hole measurements while drilling.

8. The method of claim 2 wherein hydraulic fluid is applied to a pump means and said pump means pumps drilling fluid along the drill string.

9. The method of claim 8 wherein said pump means is provided with hydraulic fluid at a fixed pressure and responds to changes in load placed thereon in pumping drilling fluid by changing hydraulic fluid flow rate.

10. The method of claim 7 wherein a pump means is operated by hydraulic fluid provided thereto at a fixed pressure and said pump means delivers drilling fluid at a fixed pressure, and invariant pressure from said pump means is applied to the drill string continuously without regard to the variable orifice.

11. The method of claim 7 wherein a multi-piston multi-stroke pump means is operated by hydraulic fluid and including the steps of applying hydraulic fluid to said pump means to provide multiple pumping strokes delivering drilling fluid to said drill string and hydraulic fluid is applied at a constant pressure to said pump means and said pump means provides drilling fluid to said drill string at a constant pressure.

12. The method of claim 11 wherein drilling fluid is delivered into the drill string at a flow rate dependent on operation of the variable orifice and wherein flow rate variations are directly proportional to variations in hydraulic fluid flow rate at a fixed pressure.

* * * * *